US005906430A

United States Patent [19]

Bayer

[11] Patent Number: 5,906,430

[45] Date of Patent: May 25, 1999

[54] CRYSTAL JEWEL ASSEMBLY FOR CHANDELIER

[75] Inventor: Georg Bayer, Plattsburgh, N.Y.

[73] Assignee: Schonbek Worldwide Lighting, Inc., Plattsburgh, N.Y.

[21] Appl. No.: 08/816,636

[22] Filed: Mar. 13, 1997

[51] Int. Cl.[6] ..... F21S 1/06; F21S 3/06

[52] U.S. Cl. ..... 362/404; 362/405; 362/406; 362/806

[58] Field of Search ..... 362/404, 405, 362/406, 806, 433, 441, 442, 437, 458, 227; D26/72; 428/8, 19; 63/1.18, 26, 29.1, 31; 248/684, 689, 690, 692

[56] References Cited

U.S. PATENT DOCUMENTS 5,109,325 4/1992 Bayer et al. ..... 362/433

5,241,460 8/1993 Schonbek ..... 362/405

*Primary Examiner*—Sandra O'Shea
*Assistant Examiner*—Michael J. Smith
*Attorney, Agent, or Firm*—Wolf, Greenfield & Sacks, P.C.

[57] ABSTRACT

The invention provides lighting fixtures, components for lighting fixtures and methods of assembling lighting fixtures. The invention involves the assembly of ornaments onto chandelier frame members without the use of hooks. The lighting fixture is sculpted by attaching ornaments to the frame in a fixed geometric pattern utilizing seating posts and retaining stops on the frame member. The frame member has an aligned position in which the retaining stops hold the crystals in place on the seating posts and a non-aligned position in which the retaining stops are moved whereby the ornaments can be placed on or off the seating posts without obstruction by the retaining stops. Preferably the chandelier is flexibly and elastically biasable into and out of the aligned and non-aligned position.

42 Claims, 6 Drawing Sheets

CRYSTAL JEWEL ASSEMBLY FOR CHANDELIER

BACKGROUND OF THE INVENTION

This invention relates to chandeliers and to sculpted ornamental arrangements for chandeliers and other lighting fixtures.

A chandelier typically is formed of a framework from which is suspended a plurality of crystal ornaments, forming the overall shape and appearance of the chandelier. The crystal ornaments typically are attached to a metal wire or "hook", which at one end has a loop that passes loosely through a hole in the crystal ornament and at the other end has a loop that passes loosely through a hole in the chandelier framework. In this manner, the crystal ornament hangs from the chandelier framework, in a single orientation which results from gravitational forces. It also is known to create "strings" of crystal ornaments, whereby a plurality of crystal ornaments are loosely held together end-to-end by a series of short hooks. Such strings of crystal ornaments also are suspended from the chandelier framework in a single orientation which results from gravitational forces. Virtually infinite chandelier designs are possible according to these prior art arrangements, although these designs are limited in that the orientation of the face of the crystal ornaments is determined always by gravitational forces. An example of a prior art chandelier framework is shown in FIG. 1 (prior art), with several ornaments or strings of ornaments hanging from the framework.

Referring to FIG. 1, a chandelier framework 20 is shown. The chandelier framework 20 includes a central post 22 carrying at its base lighting elements 24. Extending outwardly from the central post 22 is a plurality of spokes 26 which support rings 28. The rings 28, in turn, are for supporting a plurality of ornaments 30. The ornaments 30 are loosely attached to hooks 32 which are looped through openings 34 in the rings 28.

U.S. Pat. No. 5,241,460 represents an important advance in the art of chandelier design. This patent involves spring tensioning of strings of ornaments, whereby the strings of ornaments may be held in a predetermined pattern, fixed against gravitational forces. In this design, individual crystal ornaments are loosely attached to one another by short hooks or "bow ties", each bow tie comprising a pair of hooks, one of each pair passing loosely through an opening in adjacent crystals. Both ends of the string of crystals are attached to the chandelier frame member. A spring is interposed, at any number of locations, tensioning the string of crystal ornaments into a predetermined pattern opposing gravitational forces. An example of such an arrangement is shown in FIG. 2 (prior art).

Referring to FIG. 2, the chandelier has a central post 22' with a plurality of spokes 26' extending from the central post 22'. Attached to the spokes 26' are rings 28' for supporting ornaments 30'. The ornaments 30' are arranged as a string of ornaments, the adjacent ends of ornaments 30' held together by hooks 32'. One end of the string of ornaments is fixed to the lower ring by a terminal hook 32". The other end of the string of ornaments is attached to the upper ring 28' by a spring 38. The spring 38 tensions the string of ornaments to hold it in a predetermined pattern which opposes the forces of gravity.

U.S. Pat. No. 5,109,325 represents another important advance in the art of chandelier design. This patent teaches an arrangement whereby the face of an individual crystal may be oriented at virtually any angle. In this arrangement, the chandelier hook is not fitted loosely through a hole in the crystal ornament, but instead is glued to the crystal ornament, whereby the face of the crystal then is fixed relative to the orientation of the shaft of the hook. A particular hook/ring engagement mechanism also is provided whereby the hook/shaft may be positioned, for example horizontally, with respect to the chandelier frame, rather than simply hanging vertically as in the prior art designs. An example of this arrangement is shown in FIG. 3 (prior art).

Referring to FIG. 3, a ring 28" is shown with a crystal ornament 40 attached to the ring 28" by a rigid hook 42. The rigid hook 42 is glued in a bore (not shown) in the crystal ornament 40, whereby the rigid hook 42 has a fixed angular relation to the crystal ornament 40. The rigid hook 42 engages openings 44, 44' in the ring 28", whereby the rigid hook 42 is held fixed with respect to the ring 28", extending radially outwardly in a horizontal direction therefrom. As will be understood, this permits the outwardly facing surface of the crystal ornament to be oriented at a preselected angle with respect to the chandelier frame (which is not vertical). This, in turn, permits the creation of "sculpted" chandelier designs having an overall shaped-appearance defined by the outward facing surfaces of the crystals which are not necessarily vertically aligned. An example of such a design is shown in FIG. 4 (prior art).

Referring to FIG. 4, a chandelier 46 is depicted. The chandelier is formed of a plurality of crystal ornaments 40 hanging from, spring tensioned upon, or supported angularly with respect to the chandelier framework (not shown). A sculpted pattern is provided, much like an ice-sculpture.

Although the foregoing technological advances permit "sculpted" designs far beyond those previously achievable, the manufacture of such a chandelier still is cumbersome in that crystal ornaments need to be precisely attached to their hooks, and hooks need to be attached to specially designed and oriented openings in the chandelier frame. As a result, these designs are time consuming and expensive to manufacture, and also time consuming to assemble. In addition, the process of repair and cleaning is difficult, particularly if it is necessary to access the internal region of the chandelier within the bowl formed by the crystal ornaments.

The present invention involves an entirely different approach to sculpted glass ornaments for lighting fixtures.

SUMMARY OF THE INVENTION

It is an object of the invention to create an ornamental lighting fixture, wherein the position of the ornaments is largely independent of gravity and whereby the ornaments can be oriented in any manner with respect to one another.

Another object of the invention is to create a sculpted arrangement of lighting fixture ornaments which are stable in an unstable environment such as on a boat.

Another object of the invention is to provide a chandelier framework for supporting strings of ornaments which is easy to manufacture and easy to assemble.

Another object of the invention is to provide a sculpted ornamental lighting fixture that can be quickly repaired, wherein the individual ornaments are easily removable.

The present invention provides these and other advantages, wherein strings of crystals are attached to a framework backbone directly, without the use of conventional hooks. The sculpted string of crystal ornaments may be held in virtually any position while maintaining their relative position with respect to one another. The framework for the string of ornaments may be attached to other framework portions of a chandelier either before or after the crystal ornaments are assembled onto the back-bone.

According to one aspect of the invention a lighting fixture is provided. The lighting fixture has a plurality of ornaments and a frame member. The frame member has a plurality of seating posts and a plurality of stop posts. The seating posts extend from and are flexibly biasable with respect to a back-bone base. Each ornament is seated on a seating post with the seating post received in an opening within the ornament. The stop post is positioned to limit movement of the ornament off of the seating post. Preferably, the ornaments are removably received on the seating posts of the frame member. It also is preferable that the seating posts or the stop posts, or both, are biasable with respect to one another, thereby permitting either the seating posts or stop posts to be biased to an ornament inserting/removing position in which the stop posts do not limit the movement of the ornaments on to or off of the seating posts. Most preferably, the seating posts or stop posts or both, are elastically biasable with respect to one another. In one embodiment, the chandelier has a center line, and the plurality of seating posts extend outwardly from the back-bone base away from the center line of the chandelier.

Each seating post can have a seating post insertion stop for limiting movement of a respective ornament onto the seating post. There can be two seating posts received in two respective openings in each ornament (which preferably is a glass ornament). There also can be two stop posts for each ornament, one of the stop posts carrying a retaining stop for engaging one side of a face of each ornament and another of the stop posts carrying another retaining stop for engaging an opposite side of said face of each ornament.

According to another aspect of the invention, a lighting fixture having a flexible frame member is provided. The frame member has a back-bone base with a seating post extending from the base for insertion into an opening in an ornament. The frame member also has an insertion stop for limiting the extent of insertion of the ornament onto the seating post and a retaining stop for retaining the ornament on the seating post. The frame member has a non-aligned position and an aligned position, the non-aligned position permitting the ornament to be inserted onto the seating post past the retaining stop and the aligned position placing the retaining stop in juxtaposition to the ornament for retaining the ornament on the seating post. Preferably, the non-aligned position is achieved by biasing elastically a portion of the frame member from the aligned position to the non-aligned position. The retaining stop can be on a stop post extending from the back-bone base, and the seating post or the stop post, or both, can be elastically flexible with respect to one another. In one embodiment, the seating post and the retaining stop comprise a pair, and a plurality of such pairs extend from the back-bone base. Likewise, the retaining stop can be a pair of retaining stops for each ornament, and each retaining stop of each pair can be positioned on a respective stop post. The insertion stop can be on the seating post. Likewise, the back-bone base can be elastically flexible.

According to another aspect of the invention, a chandelier component is provided. The chandelier component includes a frame member and ornaments attached to the frame member. The ornaments have a pair of surfaces defining opposing faces of each ornament, and each ornament defines a plane symmetrically aligned with the pair of surfaces and interposed therebetween. The ornaments are removably secured to seating posts extending from the frame member in a manner such that the ornament planes are oriented other than vertically. The ornaments include openings, and the seating posts extend into the openings. The frame member has insertion stops for restricting the extent that the seating posts can extend into the openings and retaining stops for restricting movement of the ornaments off of the seating posts. In some embodiments, the retaining stops are on stop posts, and the seating posts or the stop posts, or both, can be elastically biasable with respect to one another. A seating post and retaining stop can comprise a pair, and the frame member can comprise a plurality of such pairs.

According to another aspect of the invention, a chandelier is provided. The chandelier includes a frame member having a back-bone base and a plurality of elongate seating posts and stop posts extending contiguously from the back-bone base. The stop posts extend from the back-bone base further than the seating posts and terminate in stop portions which extend towards the seating posts. The seating posts and stop posts are constructed and arranged to removably secure ornaments to the frame member. The chandelier can include a plurality of ornaments, each with an opening which receives a respective one of the plurality of seating posts. Each ornament can have a pair of openings which receive a respective pair of the plurality of seating posts.

According to still another aspect of the invention, a chandelier is provided. The chandelier includes a frame member having a back-bone base and a plurality of pairs of seating posts extending from the base. A plurality of ornaments is attached to the frame member, each ornament having a pair of openings. The pairs of seating posts extend into respective pairs of openings. The frame member further includes means for securing the ornaments to the seating posts. Each ornament can have a pair of surfaces defining opposing faces of each ornament, with each ornament defining a plane symmetrically aligned with the pairs of faces and interposed therebetween. Ornament planes preferably can be oriented other than vertically, vertically being defined with respect to the center line of the chandelier.

According to yet another aspect of the invention, a chandelier is provided. The chandelier includes a string of at least five ornaments in a fixed geometric pattern, each ornament defining a central plane. The ornaments are held in the fixed geometric pattern with respect to one another by a frame member having a base and extending from the base a plurality of seating posts received in openings in the ornaments. The posts have a length, a width and a thickness dimension, the width dimension being of a greater dimension than the thickness dimension. Each of the width dimensions lie in the same post plane, wherein the post plane is substantially perpendicular to the central planes defined by the ornaments. Preferably the ornaments are removably secured to the seating posts. The chandelier has a top and a bottom, and the string of ornaments can be vertically aligned with respect to the top and the bottom. The plurality of posts can comprise seating posts and stop posts, the posts for limiting movement of the ornaments on the seating posts, and wherein the seating posts or stop posts, or both, are elastically deformable out of said post plane. The seating posts can be elastically biasable with respect to the base.

According to yet another aspect of the invention, a chandelier is provided. The chandelier includes the string of at least five ornaments in a fixed geometric pattern. Each ornament defines a central ornament plane, and the ornaments are held in a fixed geometric pattern by a frame member which extends centrally of the ornaments in a plane transverse to the central ornament planes. Each ornament has at least one opening, and the frame member has a plurality of seating posts extending from a back-bone base, each seating post extending into a respective opening.

The invention also involves methods for constructing chandeliers. According to one aspect of the invention, a string of ornaments is assembled onto a frame member with an elongate back-bone base. The string of ornaments is fixed on the frame member against movement with respect to one another. The frame member then is attached to a central chandelier frame member. The string of ornaments can be attached to the frame member by a plurality of seating posts extending from and contiguous with the back-bone base. The seating posts are received in respective openings in the ornaments.

According to another aspect of the invention, a method for attaching an ornament to a chandelier frame member is provided. A chandelier frame member is flexed to a non-aligned position in which a stop is non-aligned with respect to a seating post. An ornament is inserted onto the seating post via an opening in the ornament. The seating post is inserted only partially through the opening in the chandelier ornament. In this embodiment (1) the seating post is a pair of seating posts or the stop is a pair of stops or (2) the seating post is a pair of seating posts and the stop is a pair of stops. The chandelier then is flexed into an aligned position wherein the stop is moved into a position restricting movement of the ornament off of the chandelier frame.

In all of the foregoing embodiments, the ornaments can be glass ornaments and preferably are crystal ornaments. The ornaments, of course, can be made of virtually any material. The lighting fixtures preferably are chandeliers.

DETAILED DESCRIPTION OF THE INVENTION

Figure 5:
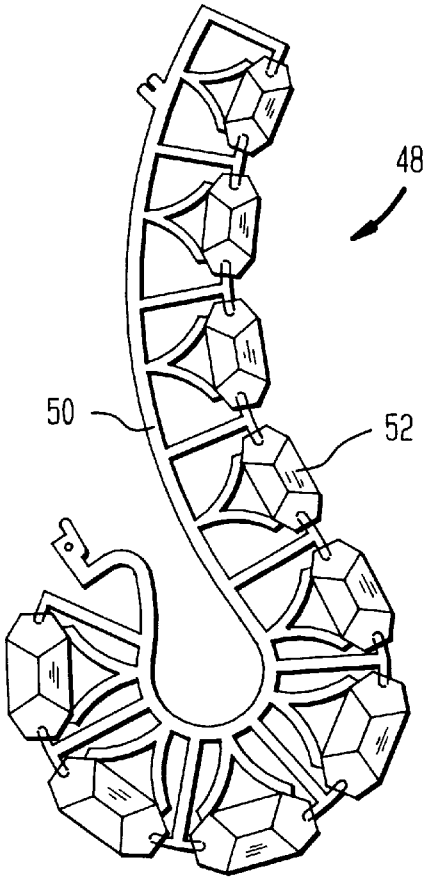
FIG. 5 is a perspective view of a chandelier frame component supporting a string of crystals in a fixed pattern according to the invention.

Referring to FIG. 5, a chandelier string 48 according to the invention is depicted. The chandelier string 48 includes two components, a frame member 50 and crystal ornaments 52. The crystal ornaments 52 are attached to the frame member 50 without the use of conventional hooks. They are oriented in different planes with respect to one another, which planes generally are transverse to the plane formed by the flat surface of the frame member defining its width. This width is of substantially greater dimension than the thickness of the frame member 50.

Figure 6:
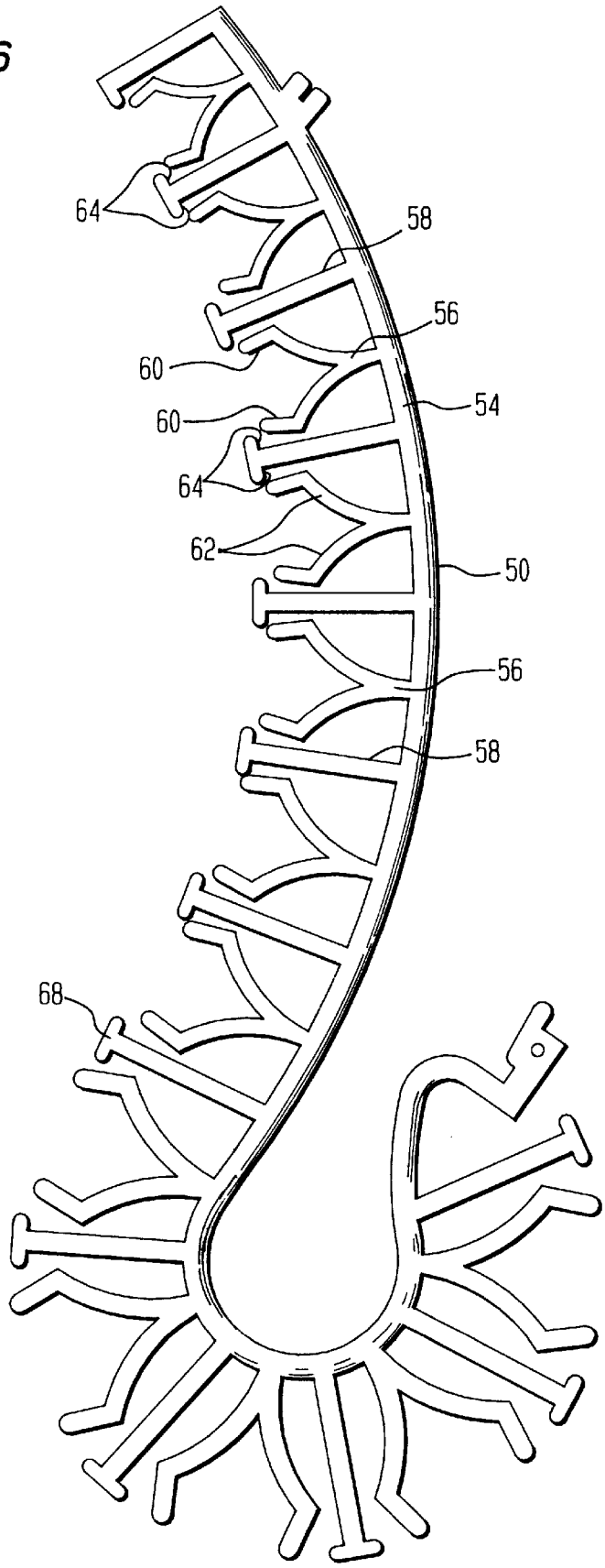
FIG. 6 is a side-view of the chandelier frame component of FIG. 5.

Referring to FIG. 6, the frame member 50 includes an elongate back-bone base 54 with a plurality of posts contiguous with and extending from the back-bone base 54. The frame member 50 is a single piece of material whereby the posts are preferably elastically flexible with respect to one another. The frame member 50 may be formed by any suitable prior art method using materials such as metal or plastic, although in a preferred embodiment the frame member is cut by a laser from flat sheet metal. The preferred sheet-metal is Steel Strip, 0.024 in.×6–12 in. wide, C1008/1010 ASTM A104, Temper Full-Hard Rockwell B84 Minimum. However, other raw materials which are easy to laser cut and have "memory" to accomodate the deformations required by the present invention may also be used. Alternatively, Stainless Steel High Tensile, 0.024 in.×36×60, type 304, ASTM A666, 150,000 min. PSI Tensile, may also be used. Such material requires no subsequent plating or finishing. The use of alternative materials are also considered to be within the scope of the present invention. In selecting the material of the frame member and its dimensions, it is important that the frame member be flexible, preferably elastically flexible, to permit attachment of the crystal ornaments as described in greater detail below.

As shown, the back-bone base 54 and posts 56, 58 extending therefrom have flat surfaces that lie within a plane, which surfaces are substantially greater in dimension than the thickness (t) of the frame member. The thickness (t) of the frame member in the embodiment shown in FIG. 6 is approximately 0.024 in. The width (w) of the back-bone base may be any desirable size. In this manner, the posts 56, 58 are elastically flexible with respect to one another, particularly in and out of the plane defined by the flat planer surfaces of the frame member 50. The utility of this flexibility will be further described below.

Extending from the back-bone base 50 are a plurality of seating posts 56 and stop posts 58. Each seating post 56 has a pair of end-segments 60 for insertion into a respective pair of openings in the crystal ornament. Each seating post 56 also has a pair of seating post stops 62 for limiting advancement of the crystal ornament onto the seating posts.

Each stop post 58 terminates in a pair of ornament retaining stops 64. The retaining stops 64 are juxtaposed with respect to the crystal ornaments 52 when the ornaments are seated on the end-segments 60 of the seating post 56 so as to limit movement of the ornaments off of the seating posts.

Figure 7:
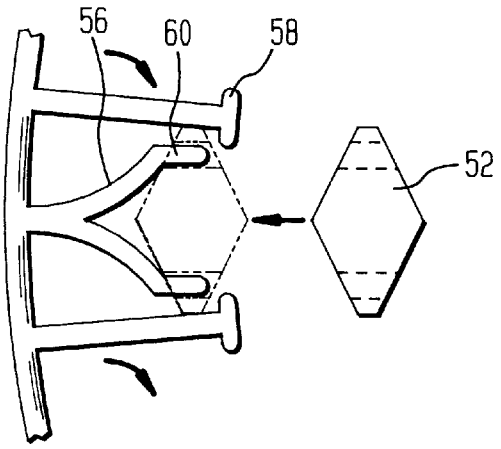
FIG. 7 is a side-view of a portion of the frame assembly of FIG. 6, shown with a glass ornament adjacent thereto.
Figure 8:
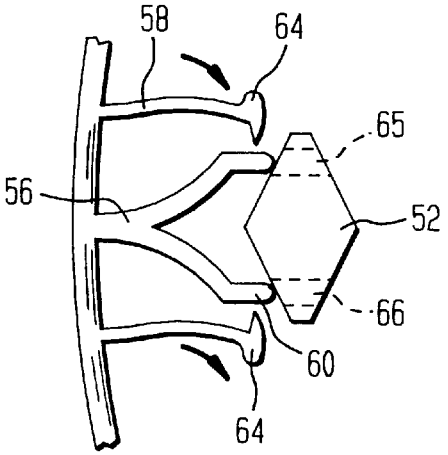
FIG. 8 depicts the same side-view as FIG. 7, except that the stop posts have been biased out of alignment with the seating posts to permit assembly of the glass ornament onto the seating posts.

Referring now to FIGS. 7 and 8, the frame member 50 has an unbiased, aligned orientation in its resting position, wherein a crystal ornament is restricted from being placed on the seating posts 56 by the stop posts 58. As shown in FIG. 8, the stop posts 58, or the seating posts 56 (not shown), or both (not shown), are flexed or biased to a position in which the retaining stops 64 are flexed elastically out of alignment with the end segments 60, whereby the crystal ornament 52 may be inserted onto the end segment 60 of the seating posts 56 via a pair of respective openings 66 in a crystal ornament 52. The crystal ornament 52 is inserted onto the end segments 60 of the seating posts 56 until the surface of the crystal facing the frame member abuts the seating post stops 62, which limit further movement of the crystal ornament 52 onto the seating post 62. The biasing force on the stop posts 58 then is released, whereby the stop posts 58 return to their planer arrangement with respect to the seating posts 56, thereby bringing the retaining stops 64 into alignment with the outwardly facing surface 65 of the crystal ornaments 52. The retaining stops 64 then prevent movement of the crystal ornament 52 off of the end segments 60 of the seating posts 56.

Thus, the frame members have an aligned position and a non-aligned position. In the aligned position, the retaining stops of the stop posts are juxtaposed with respect to the end segments of the seating posts, whereby a crystal ornament cannot be advanced onto the end segments because the retaining stops are in the way. When either or both of the seating posts and stop posts are flexed out of their planer arrangement, the end segments 60 of the seating posts are accessible, free of obstruction by the retaining stops, and the crystal ornament can be simply inserted thereon. Once the crystal ornament is inserted thereon, then the flexing force is released, and the frame member is permitted to spring back into its aligned position with the retaining stops positioned to retain the crystal ornament on the seating posts.

Figure 9:
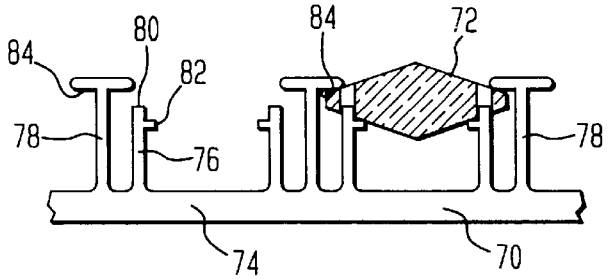
FIG. 9 is a side-view of another embodiment of the invention, depicting a portion of a chandelier frame member with a cross-sectional view of a glass ornament mounted on the frame member.

Referring to FIG. 9, another embodiment of a portion of a frame member according to the invention is depicted. The frame member 70 is shown with a crystal ornament 72 (in cross-section) assembled onto it. The frame member 70 has a back-bone base 74. Extending from the back-bone base are elongate seating posts 76 and elongate stop posts 78. The seating posts 76 terminate in a short, straight end segment 80 which, when assembled, is inserted into an opening in the crystal ornament 72. Close to the free-end of the end segment 80 is a seating post stop 82, which extends from the seating post substantially perpendicularly with respect to the elongate axis of the seating post and defines the end segment 80. The seating post stop 82 limits advancement of the crystal ornament 72 onto the seating post 76.

The stop posts 78 extend outwardly from the back-bone base parallel to the seating post, but extend slightly further outwardly from the back-bone base than the seating posts. Each elongate stop post 78 terminates in a head region defining a pair of retaining stops 84. The retaining stops 84 extend toward the free end of respective adjacent seating posts, whereby the retaining stops are juxtaposed adjacent to the free-ends of the end segments, obstructing insertion of a crystal ornament into the free-ends of the end segments 80. As with the prior embodiment, the seating posts and stop posts may be flexed relative to one another out of their planar arrangement whereby the crystal ornament 72 can be placed on the free-ends of the end segments 80. The seating posts and stop posts then are permitted to flex back to their planar position, whereby the retaining stops 84 of the stop posts are brought into aligned juxtaposition with respect to the end segments 80, restricting movement of the crystal ornament 72 off of the end segments of the seating posts.

As will be seen from FIGS. 6 and 9, pairs of seating posts are interrupted along the back-bone base by single stop posts. Each stop post, however, carries a pair of retaining stops, one for each of the seating posts on either side of each stop post. This is in contrast to the arrangement of FIG. 10, which includes pairs of a seating post and a combination seating/stop post.

Figure 10:
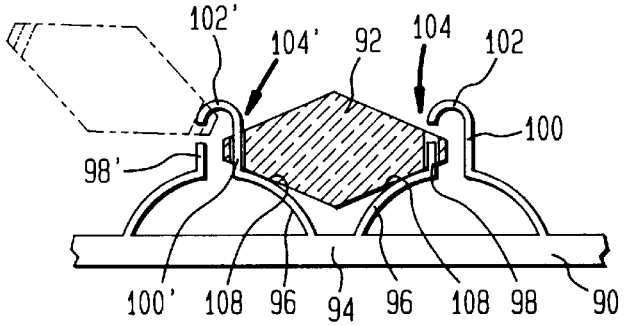
FIG. 10 is a side-view of another embodiment of the invention, depicting a portion of a chandelier frame member with a cross-sectional view of a glass ornament mounted on the frame member.

Referring to FIG. 10, a frame member 90 is shown with a crystal ornament 92 (shown in cross-section) secured thereto. The frame member has a back-bone base 94 and elongate seating posts 96 extending therefrom. The seating posts 96 extend from the back-bone base 94 substantially in the form of the upper portion of a "Y". At the end of one arm of the "Y" is a substantially straight end segment 98 to be inserted into an opening in the crystal. The end segment 98 is substantially straight. This arrangement is similar to the arrangement shown in FIG. 6. In contrast to the frame member shown in FIG. 6, the other arm of the "Y" is an end segment that has a substantially straight seating portion 100, terminating in an arcuate hook portion which extends away from the internal region of the "Y" towards the free-end of an end segment 98 of an adjacent "Y". This curved portion of the free-end of the arm of the "Y" acts as a retaining stop 102.

To assemble the crystal ornament onto the chandelier frame member 90, the free-end of end segment 98' and retaining stop 102' are flexed out of alignment and one end of the crystal ornament 92 (shown in phantom) is inserted onto the free, hooked end of the retaining stop 102'. It is rotated over this hooked end until the opening 104' in the crystal ornament is positioned over straight seating portion 100'. To insert opening 104 on the opposite end of crystal ornament 92 onto seating post 98, retaining stop 102 and seating post 98 are flexed out of alignment whereby the opening 104 can be positioned over the free-end of end segment 98 and onto end segment 98. The end segments and retaining stops are permitted to assume their aligned position, whereby the retaining stops 102, 102' prevent movement of the crystal ornament 92 off of the end segment 98 and short, straight segment 100'.

Figure 11:
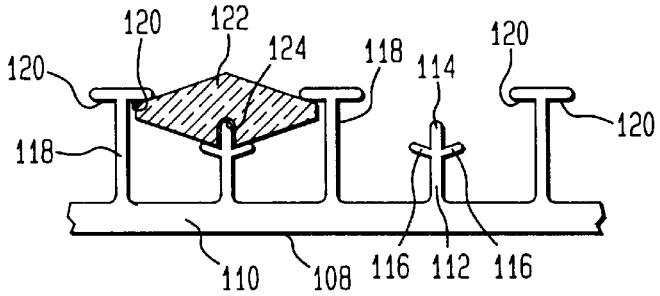
FIG. 11 is a side-view of another embodiment of the invention, depicting a portion of a chandelier frame member with a cross-sectional view of a glass ornament mounted on the frame member.

Referring to FIG. 11, an arrangement is shown wherein there is only a single opening in each crystal and only a single seating post for each crystal. The frame member 108 includes an elongate back-bone base 110 with a plurality of seating posts 112 and stop posts 118 extending therefrom. A single seating post 112 is positioned between a pair of stop posts 118, equidistant therebetween. The seating post terminates in a short, straight end segment 114 for being received into an opening in a crystal ornament. Extending from the seating post 112 laterally on either side of end segment 114 (and defining end segment 114) are a pair of seating post stops 116 for limiting advancement of the crystal ornament onto the seating post 112. The stop posts extend outwardly from the back-bone base 110 further than the free-end of the seating posts and terminate in a head region defined by a pair of laterally-extending stops 120. The stops on adjacent stop posts extend toward one another and toward the free-end of the seating post 112. A crystal ornament 122 is captured on the frame member 108 by the seating posts 112 and stop posts 118. The end segment 114 of the seating post 112 extends into an opening 124 of the crystal ornament 122. The seating post stops 116 abut the surface of the crystal ornament facing the elongate back-bone base 110, thereby limiting further advancement of the crystal ornament onto the seating post. The retaining stops 120 abut the opposite face of the crystal ornament 122, restricting movement of the crystal ornament 122 off of the seating post 112.

To assemble the crystal onto the chandelier frame member, the seating post and/or the stop posts are flexed out of their planer resting arrangement and the crystal ornament 122 is placed onto the seating post 112 by inserting the end segment 114 of the seating post 112 into the opening 124 of the crystal ornament 122. Advancement of the crystal ornament 122 onto the seating post 112 is limited by seating post stops 116 which abut the surface of the crystal ornament facing the back-bone base of the frame member and prevent further advancement of the crystal ornament 122 onto the seating post 112. (It will be understood that in other embodiments, the free-end of the end segment 114 of the seating post can act as the seating post stop. In such an arrangement, the opening in the crystal 122 cannot extend completely through the crystal ornament 122. In this manner, the crystal ornament is inserted over the seating post until the free-end of the seating post contacts the dead-end of the opening or bore in the crystal ornament.) Once the crystal ornament 122 is seated on the seating post, the frame member is permitted to assume its resting position with the retaining stops 120 positioned in a manner with respect to the outwardly facing surface of the crystal ornament 122 to restrict movement of the crystal ornament 122 off of the free-end of the seating post 112.

Figure 12:
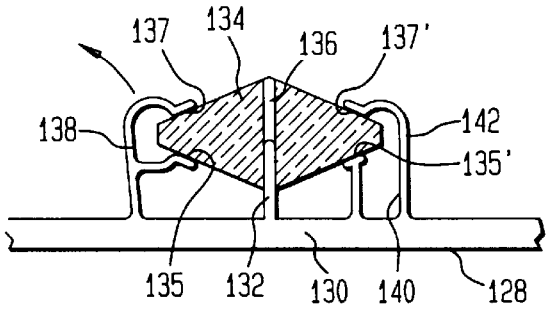
FIG. 12 is a side-view of another embodiment of the invention, depicting a portion of a chandelier frame component with a cross-sectional view of a glass ornament mounted on the frame member.

FIG. 12 shows yet another embodiment of the invention. This embodiment also shows an arrangement employing only a single seating post for each crystal ornament. Referring to FIG. 12, a frame member 128 includes a back-bone base 130. Extending from the back-bone base are a plurality of seating posts 132 and a plurality of stop posts. In the embodiment depicted, a crystal ornament 134 has a central bore extending partially through the ornament. As with the prior embodiment, stop posts are biased out of the way and the crystal ornament is placed on the seating post 132 by inserting the seating post into the bore or opening 136 of the crystal ornament 134. Two different arrangements of stop posts are shown in FIG. 12. Both arrangements include a pair of stops, one for limiting advancement of the crystal ornament 134 onto the seating post 132 and another stop for limiting movement of the crystal ornament 134 off of the seating post 132. At one side of the crystal ornament 134 (left-hand side in FIG. 12) a stop post 138 substantially in the shape of an "F" is provided. In this arrangement the two lateral arms of the stop post 138 terminate at their free ends in stops, one of the arms defining stop 135 for limiting advancement of the crystal ornament 134 onto the seating post 132 and the other of the arms defining stop 137 for limiting movement of the ornament off of the seating posts. When stop post 138 is flexed, the two lateral arms of the "F" which extend toward the end of the crystal ornament in a resting position are flexed together out of alignment with the seating post 132, whereby the crystal ornament can be inserted onto or off of the seating post 132. When the "F-shaped" stop post 138 is permitted to assume its resting position in alignment with the seating post 132, the end of the crystal ornament 134 is sandwiched between the laterally-extending arms of the "F-shaped" stop posts, captured therebetween and prevented from movement by stops 135, 137.

As shown in the arrangement at the opposite side of the crystal ornament in FIG. 12, it is not necessary that the two stops which sandwich the end of the crystal therebetween extend from a single post as in the "F-shaped" stop. Instead, a seating post 140 terminating in stop 135' can extend independently from the back-bone base 130 for limiting advancement of the crystal ornament 134 onto the seating post 132. A second arcuate ornament retaining stop post 142 also can extend from the back-bone base 130 to provide a stop 137' at the free-end of the stop post 142 for limiting movement of the crystal ornament 134 off of the seating post 132.

Additional embodiments are shown in FIGS. 13–17, below. In all of these embodiments, different arrangements of similar structures are provided. In particular, all of these arrangements include a frame member with a back-bone base. In one embodiment (FIG. 15) it is illustrated that the back-bone base need not be an elongate thin structure, but instead can be a solid structure and can act as a retaining stop. All of the structures include a seating post, which is defined by a portion of a post which extends into an opening in a crystal ornament. All of these structures also include seating post stops, which limit further advancement of the crystal ornaments onto the seating posts. Likewise, all of the structures include retaining stops, which limit movement of the crystal ornaments off of the free-end of the seating posts when the crystal ornaments are assembled onto the frame member and the frame member is in a resting position.

Figure 13:
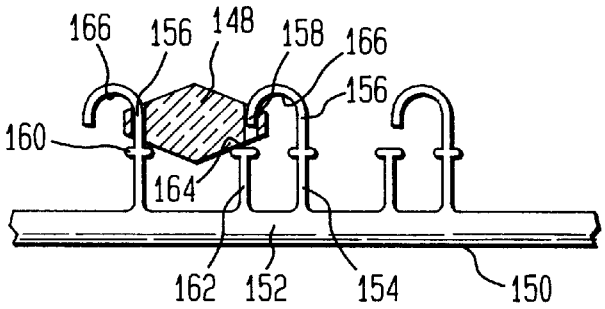
FIG. 13 is a side-view of another embodiment of the invention depicting a portion of a chandelier frame component with a cross-sectional view of a glass ornament mounted on the frame member.

Referring specifically to FIG. 13, a crystal ornament 148 is shown assembled on a frame member 150. The frame member 150 includes an elongate back-bone base 152. Extending from and contiguous with the back-bone base are seating posts 154. Each seating post 154 extends from the back-bone base 152 terminating in an arcuate, hooked segment. The arcuate segment extends from a short, straight segment 156 and terminates at its free-end with another shorter, straight segment 158. Segments 156 and 158 act as the seating portions which extend into the openings of adjacent crystals when the crystals are seated on the frame member. The arcuate segment acts as a retaining stop for one of the adjacent crystal ornaments and a seating stop for the other, discussed further below. Each seating post also includes a seating post stop 160, which limits advancement of one end of a crystal ornament further onto the short, straight segment 156. Also extending from the back-bone base 152 is a stop post 162 ending in a retaining stop 164. The stop post 162 positions the retaining stop 164 in juxtaposition to the free-end of seating post shorter straight segment 158, limiting movement of the crystal ornament 148 from the free-end of segment 158 when the crystal ornament 148 is assembled onto the frame member 150. The arcuate surface 166 of the seating post 154 between segments 156 and 158 limits movement of the crystal ornament 148 in a direction away from the elongate back-bone base 152 when the crystal ornament 148 is assembled onto the chandelier frame. The arcuate segment 166 then is preventing movement of an ornament off of one seating post and preventing movement of an adjacent ornament onto the same seating post. The seating post stop and a respective retaining post stop 164 limit movement of the ornament 148 in a direction toward the elongate back-bone base 152. Assembly is similar to that described in connection with FIG. 10.

Figure 14:
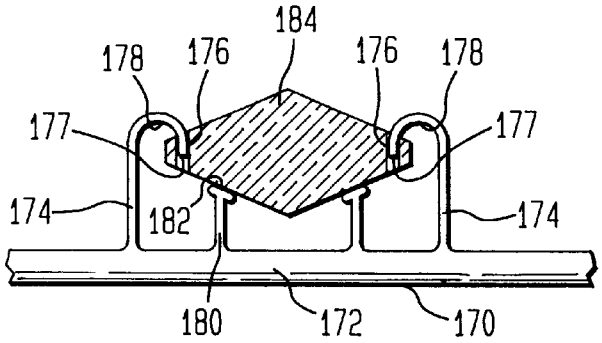
FIG. 14 is a side-view of another embodiment of the invention, depicting a portion of a chandelier frame member with a cross-sectional view of a glass ornament mounted on the frame member.

Referring to FIG. 14, a frame member 170 with an elongate back-bone base 172 is shown. Extending from the back-bone base 172 is a pair of seating posts 174. The seating posts 174 are shaped like hooks, with the open ends of the hooks facing one another. The end of the hook, or the free-end of the seating post 174 defines short, straight end segments 176 for receiving a crystal ornament. These end segments extend toward the back-bone base 172. The curved position of the seating post 174 distal from the free-end of seating post 174 and adjacent the end segment 176 acts as a stop limiting further advancement of the crystal ornament onto the seating post 174. Also extending from the back-bone base 172 between the pair of seating posts 174 are a pair of stop posts 180, each of which terminates in a retaining stop 182. These retaining stops 182 limit movement of the crystal ornament 184 off of the free-ends 177 of the retaining post 174 when the crystal ornament 184 is assembled onto the receiving post 174. As will be readily seen, the crystal ornament 184 is assembled onto and off of the elongate frame member 170 by flexing the retaining posts and/or the seating posts whereby the crystal ornament 184 can be moved onto and off of the free-ends 177 of the seating posts 174, free of interference from the retaining stops 184. Once the ornament is placed on the seating posts, the stop posts are permitted to resume their resting aligned position, whereby the retaining stops abut a face of the ornament and restrict movement of the ornament off of the seating posts.

Figure 15:
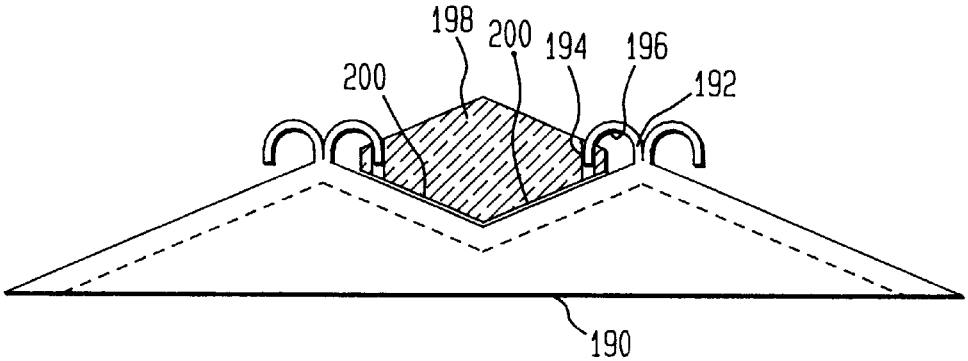
FIG. 15 is a side-view of another embodiment of the invention, depicting a portion of a chandelier frame member with a cross-sectional view of a glass ornament mounted on the frame member.

FIG. 15 illustrates another embodiment of the invention. FIG. 15 is similar in several respects to the embodiment shown in FIG. 14. FIG. 15 includes a frame member 190. Extending from the frame member 190 are seating posts 192, which are generally shaped as hooks. Pairs of these seating posts 192 face one another, with the free-ends of the hooks closest to one another. The hooks terminate in short, straight end-segments 194, which are for inserting into openings in crystal ornaments 198. The curved portion 196 of the seating posts 192 immediately adjacent to the short, straight segments 194 (and distal to the free-end), acts as a stop limiting movement of the crystal ornament 198 further onto the seating post 192. This embodiment differs from that shown in FIG. 14 in that the embodiment of FIG. 15 does not include stop posts extending from a back-bone. Instead, the retaining stops 200 simply are defined by the crystal-facing edge of the frame member 190, which also faces the free-ends of the short segments 194. These retaining stops 200, in the arrangement shown in FIG. 15, cannot be flexed like a stop post to permit the crystal ornament 198 to be removed from the free-ends of the seating posts 192. Instead, in this embodiment, only the seating posts 192 can be flexed out of their alignment from within or into the openings in the crystal ornaments 198.

Figure 16:
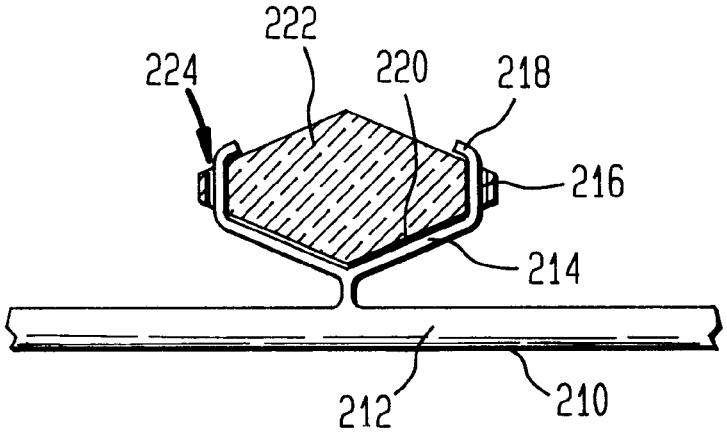
FIG. 16 is a side-view of another embodiment of the invention, depicting a portion of a chandelier frame member with a cross-sectional view of a glass ornament mounted on the frame member.

FIG. 16 depicts another embodiment of the invention. In this embodiment, a frame to member 210 includes a back-bone base 212. Extending from the back-bone base is a plurality of "Y"-shaped seating posts 214. The seating posts include a short, straight seating segment 216 adjacent the free-end of each arm of the "Y"-shaped seating posts. At the free-end of each seating post arm, just after the short, straight segment, is a terminal-end bend. The free ends of bends of each arm of the "Y"-shaped seating posts face one another. These bends act as retaining stops 218. Thus, beginning at the free-end of each arm is a retaining stop 218, a short straight segment 216 for being positioned within an opening 224 of the crystal ornament 222, and then another bend which acts as a seating post stop 220 limiting advancement of the crystal ornament 222 further onto the seating posts 214.

In the embodiment shown in FIG. 16, the arms of the "Y"-shaped seating posts are flexed apart, whereby the bends 218 can be inserted into and through the openings 224 of the crystal ornament. Once the bends 218 pass through the openings 224, the frame member is allowed to resume its resting position whereby the arms of the "Y"-shaped seating posts flex towards one another, positioning the openings of the crystal ornament along the short, straight segments 216 of the seating posts 214. In this position, the retaining stops 218 abut the outward face of the crystal ornament 222, preventing the crystal ornament 222 from being removed from the seating posts 214. The seat post stops 220 abut the opposite face of the crystal ornament 222 and prevent further advancement of the crystal ornament 222 onto the seating posts 214.

Figure 17:
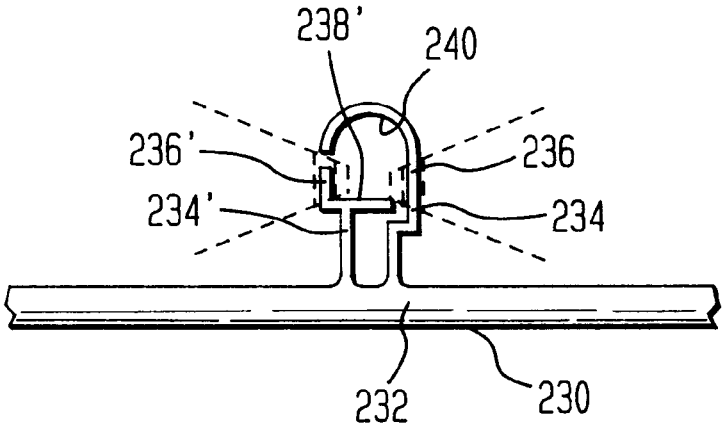
FIG. 17 is a side-view of still another embodiment of the invention, depicting a portion of a frame member with a cross-sectional view of two glass ornaments (in phantom) mounted on the frame member.

FIG. 17 depicts another embodiment of the invention. In this embodiment, a frame member 230 includes an elongate back-bone base 232. Extending from the back-bone base 232 is a pair of adjacent posts for securing adjacent ends of a pair of crystal ornaments (shown in phantom). Post 234 is, in general, in the shape of a question mark. It includes a short, straight seating segment 236 for positioning within an opening at the edge of a crystal ornament. Extending from the short, straight segment 236 is a hooked segment which extends toward the adjacent seating post 234'. The terminal, free-end of seating post 234 acts as a retaining stop, limiting movement of a crystal ornament off of adjacent seating post 239'.

The adjacent seating post 234' also includes a seating post stop 238 distal from the free-end and short segment 236', which limits movement of a crystal ornament onto short, straight segment 236'. Because of the juxtaposition of seat post stop 238' to short straight segment 236 of seating post 234, the seating post stop 238' also limits movement of a crystal ornament further onto seating post 234. The curved portion 240 adjacent the free-end of seating post 234 acts to limit movement of crystal ornaments off of either short straight segment 236 or short straight segment 236'.

The frame members depicted can have varying degrees of flexibility, as desired, so long as the stops and seating posts can be biased out of alignment to permit insertion of the ornaments onto the seating posts. In certain embodiments, the frame member is oriented vertically and unstressed along its length when attached to the central chandelier framework. In this manner, the string of ornaments will be vertically aligned.

It also should be understood, however, that the frame member need not be vertically aligned or unstressed. Instead, as an example only, the frame member (such as a straight frame member along its length) may be twisted to produce a spiral of ornaments or may be flexed in its thickness dimension to create an S-shape of crystals. Virtually any arrangement is possible.

The invention, thus, in one broad aspect involves a frame member having a back-bone base and a plurality of seating posts extending from the base. The plurality of ornaments, each ornament having a pair of openings, are placed on the frame member with the seating posts extending into a respective pair of openings. Means are provided for securing the ornaments on the seating posts. In the embodiments described above, the means for securing the ornaments on the seating posts includes retaining stops which may be on the seating posts, on the back-bone base or on stop posts. It also is the case that the ornaments could be, for example, glued directly to the pairs of seating posts. The invention is not intended to be limited by any particular means for securing ornaments to the seating posts.

The present invention lends itself to a variety of embodiments, only some of which are described above. In all of the embodiments depicted, the seating posts, stop posts, or both are elastically flexible with respect to one another to permit insertion of the crystal onto the seating posts. It should be understood, however, that it is not required that the seating posts and stop posts be elastically biasable with respect to one another. It is possible, for example, to deformably twist the heads of the stop posts (such as in FIG. 6) 90°, whereby the retaining stops will be moved away from the end segments. This could involve non-elastic deformation of the stop posts could be accomplished with, for example, a pair of pliers. Once the crystal ornament was placed onto the end segments of the seating posts, the heads of the stop posts could be twisted back into alignment to retain the crystal ornament on the seating posts. It is preferred, however, that the seating posts, stops, or both are elastically biased with respect to one another to permit the crystal ornament to be assembled onto the chandelier frame member, as this can be accomplished quickly and without permanent deformation to the frame member which might cause some misalignment of the chandelier ornaments.

It will be understood that the foregoing represents only the various preferred embodiments of the present invention. Numerous other embodiments and equivalents will be apparent to those of ordinary skill in the art and the invention is not intended to be limited in any respect thereby.

What is claimed is:

1. A lighting fixture comprising:

a plurality of ornaments, a frame member having a plurality of seating posts and a plurality of stop posts, the seating posts extending from and flexibly biasable with respect to a back-bone base, wherein each ornament is seated on a seating post with the seating post received in an opening within the ornament and wherein the stop post limits movement of the ornament off of the seating post.

2. The lighting fixture of claim 1, wherein the chandelier has a central post defining a center line, and wherein said plurality of seating posts extend outwardly from the back-bone base and wherein said frame member is constructed and arranged such that said plurality of seating posts extend away from the center line of the chandelier.

3. The lighting fixture of claim 1, wherein the ornaments are removably seated on the seating posts of the frame member.

4. The lighting fixture of claim 1, wherein the seating posts or the stop posts, or both, are biasable with respect to one another, thereby permitting either the seating posts or stop posts to be biased to an ornament inserting/removing position in which the stop posts do not limit the movement of the ornaments on or off of the seating posts.

5. The lighting fixture of claim 1, wherein each seating post has a seating-post insertion stop for limiting movement of a respective ornament onto the seating post.

6. The lighting fixture of claim 1, wherein there are two stop posts for each ornament, one stop post on one side of a face of each ornament and another stop post on an opposite side of said face of each ornament.

7. The lighting fixture of claim 1, wherein the ornaments are glass ornaments and wherein there are two seating posts received in two respective openings in each glass ornament.

8. The lighting fixture of claim 4, wherein there are two stop posts for each ornament, one stop post on one side of a face of each ornament and another stop post on an opposite side of said face of each ornament.

9. The lighting fixture of claim 4, wherein the ornaments are glass ornaments and wherein there are two seating posts received in two respective openings in each glass ornament.

10. A lighting fixture having a flexible frame member comprising:

a back-bone base, a seating post extending from said base for insertion into an opening in an ornament, an insertion stop on said frame member for limiting the extent of insertion of the ornament on the seating post, and a retaining stop on the frame member for retaining the ornament on the seating post, wherein the frame member has a non-aligned position and an aligned position, said non-aligned position permitting said ornament to be inserted onto said seating post past said retaining stop, and said aligned position placing said retaining stop in juxtaposition to said ornament for retaining said ornament on said seating post.

11. The lighting fixture of claim 10, wherein the non-aligned position is achieved by biasing elastically a portion of the frame member from the aligned position to the non-aligned position.

12. The lighting fixture of claim 10, wherein the retaining stop is on a stop post extending from the back-bone base, and wherein the seating post or the stop post, or both, are elastically flexible with respect to one another.

13. The lighting fixture of claim 10, wherein the seating post and retaining stop comprise a pair, and wherein a plurality of said pairs extend from the back-bone base.

14. The lighting fixture of claim 10, wherein the retaining stop is a pair of retaining stops.

15. The lighting fixture of claim 14, wherein each retaining stop of said pair of retaining stops is positioned on a respective retaining post.

16. The lighting fixture of claim 10, wherein the insertion stop is on the seating post.

17. The lighting fixture of claim 10, wherein the back-bone base is elastically flexible.

18. The lighting fixture of claim 12, wherein the back-bone base is elastically flexible.

19. The lighting fixture of claim 10, wherein the lighting fixture is a chandelier.

20. A chandelier component comprising:

a frame member having a seating post extending from a base, an ornament having at least one opening extending between opposing faces of the ornament, wherein the seating post extends into an opening of the ornament causing the ornament to be removably secured to the seating post, an insertion stop on the frame member restricting the extent that the seating post can extend into the opening, and a retaining stop on the frame member restricting movement of the ornaments off of the seating post.

21. The chandelier component of claim 20, wherein the retaining stop is on a stop post, and wherein the seating post and the stop post are flexibly biasable with respect to one another.

22. The chandelier component of claim 20, wherein the seating post and retaining stop comprise a pair and wherein the frame member comprises a plurality of said pairs.

23. The chandelier component of claim 22, wherein the ornament is a glass ornament and wherein there is at least one glass ornament associated with each pair.

24. A chandelier comprising:

a frame member having a back-bone base and a plurality of elongate seating posts and stop posts extending contiguously from said back-bone base, wherein the stop posts extend from the back-bone base further than the seating posts and terminate in stop portions which extend toward the seating posts, the seating posts and stop posts constructed and arranged to removably secure ornaments to the frame member.

25. The chandelier of claim 24, further comprising a plurality of ornaments, each with an opening which receives a respective one of said plurality of seating posts.

26. The chandelier of claim 24, further comprising a plurality of ornaments, each ornament having a pair of openings which receive a respective pair of said plurality of seating posts.

27. The chandelier of claim 25, wherein the ornaments are glass ornaments.

28. A chandelier comprising:

a frame member having a back-bone base and a plurality of pairs of seating posts extending from the base, a plurality of ornaments, each ornament having a pair of openings, wherein each of said pairs of seating posts extends into a respective pair of openings, and means on the frame member for securing the ornaments to the seating posts.

29. The chandelier of claim 28, wherein the ornaments are glass ornaments.

30. A chandelier comprising:

a string of at least five ornaments in a fixed geometric pattern, each ornament defining a central plane, and the ornaments being held in said fixed geometric pattern with respect to one another by a frame member having a base and extending from the base a plurality of seating posts received in opening in the ornaments, the posts having a length, a width, and a thickness dimension, the width dimension being of a greater dimension than the thickness dimension and each of the width dimensions lying in the same post plane, wherein the post plane is substantially perpendicular to the central planes defined by the ornaments.

31. The chandelier of claim 30, wherein the ornaments are removably secured on the seating posts.

32. The chandelier of claim 30, wherein the chandelier has a top and a bottom and wherein the string of ornaments is vertically aligned with respect to the top and the bottom.

33. The chandelier of claim 31, wherein the chandelier has a top and a bottom and wherein the string of ornaments is vertically aligned with respect to the top and bottom.

34. The chandelier of claim 30, wherein the plurality of posts comprises seating posts and stop posts, the stop posts for limiting movement of the ornaments on the seating posts, and wherein the seating posts or stop posts, or both, are elastically deformable out of said post plane.

35. The chandelier of claim 30, wherein the seating posts are elastically biasable with respect to the base.

36. A chandelier comprising:

a string of at least five ornaments in a fixed geometric pattern, each ornament defining a central ornament plane, the ornaments held in the fixed geometric pattern by a frame member having a back-bone base which extends centrally of the ornaments in a plane transverse to the central ornament planes, wherein each ornament has at least one opening, wherein the frame member has a plurality of seating posts extending from the back-bone base, one seating post for each of said openings, and wherein said seating posts are received in said openings.

37. A chandelier of claim 36, wherein the ornaments are glass ornaments.

38. A method for constructing a chandelier comprising:

assembling onto a back-bone base frame member a string of ornaments, the string of ornaments fixed on the back-bone base frame member against movement with respect to one another, and attaching said back-bone base frame member to a central chandelier frame member.

39. The method of claim 38, wherein the ornaments are glass ornaments.

40. A method for attaching an ornament to a chandelier frame member comprising:

flexing the chandelier frame member to a non-aligned position in which a stop is non-aligned with respect to a seating post, inserting the ornament onto the seating post via an opening in the ornament, and flexing the chandelier into an aligned position wherein the stop is moved into a position restricting movement of the ornament off of the chandelier frame, wherein the seating post is inserted only partially through the chandelier ornament and wherein (1) the seating post is a pair of seating posts or the stop is a pair of stops or (2) the seating post is a pair of seating posts and the stop is a pair of stops.

41. The method of claim 40, wherein the stop is a pair of stops.

42. The method of claim 40, wherein the seating post is a pair of seating posts.

* * * * *

UNITED STATES PATENT AND TRADEMARK OFFICE

CERTIFICATE OF CORRECTION

PATENT NO. : 5,906,430

DATED : May 25, 1999

INVENTOR(S) : Georg Bayer

Figure 1:
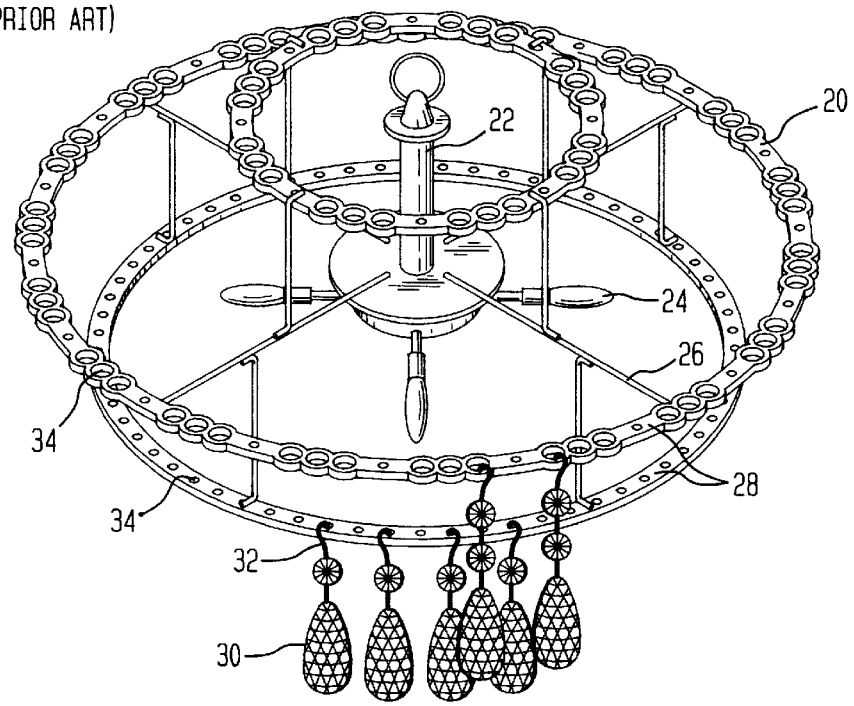
FIG. 1 (PRIOR ART)
FIG. 1 is a perspective view of a prior art chandelier frame assembly with several ornaments attached.
Figure 2:
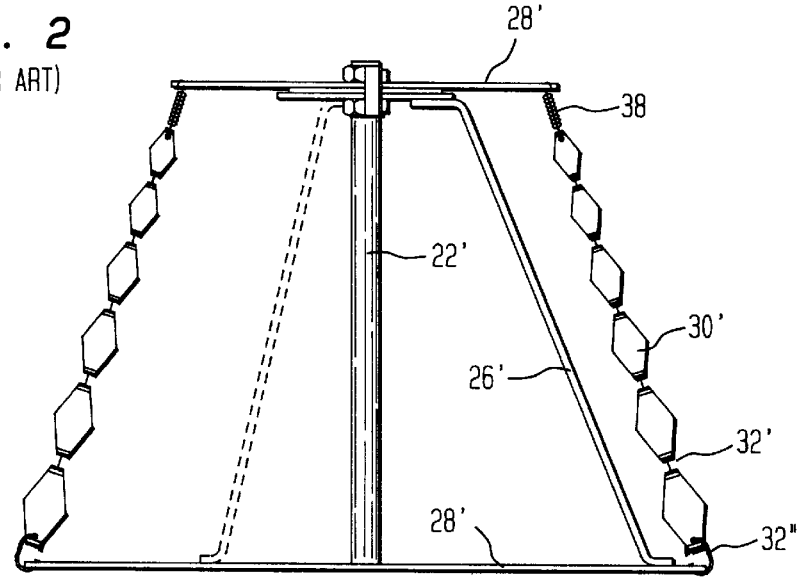
FIG. 2 (PRIOR ART)
FIG. 2 is a side-view of a prior art chandelier frame assembly with two strings of ornaments attached by spring tensioning.
Figure 3:
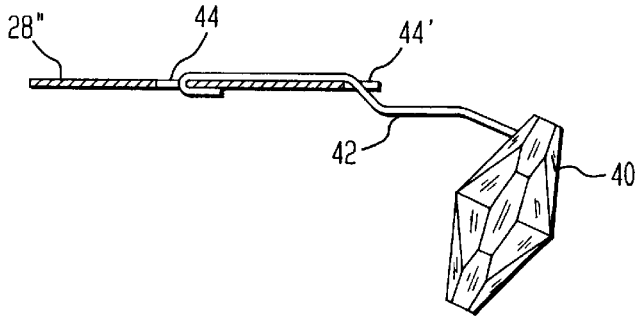
FIG. 3 is a partial-cross section of a prior art frame member/hook/crystal assembly.
Figure 4:
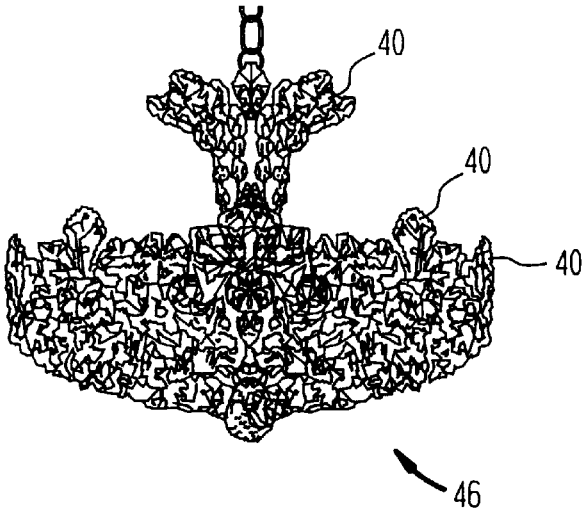
FIG. 4 is a perspective view of a prior art sculpted chandelier.

It is certified that error appears in the above-indentified patent and that said Letters Patent is hereby corrected as shown below:

In the Drawings:

Label Figure 3 (PRIOR ART).

Signed and Sealed this

Sixteenth Day of November, 1999

*Attest:*

*Attesting Officer*

Q. TODD DICKINSON

*Acting Commissioner of Patents and Trademarks*